US010046561B2

(12) United States Patent
Hoshii

(10) Patent No.: US 10,046,561 B2
(45) Date of Patent: Aug. 14, 2018

(54) PRINTING APPARATUS AND PRINTING METHOD

(71) Applicant: SEIKO EPSON CORPORATION, Tokyo (JP)

(72) Inventor: Jun Hoshii, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/461,785

(22) Filed: Mar. 17, 2017

(65) Prior Publication Data

US 2017/0282536 A1 Oct. 5, 2017

(30) Foreign Application Priority Data

Mar. 30, 2016 (JP) ..... 2016-067503

(51) Int. Cl.
*B41J 29/393* (2006.01)
*B41J 2/045* (2006.01)

(52) U.S. Cl.
CPC ..... *B41J 2/0454* (2013.01); *B41J 2/04586* (2013.01)

(58) Field of Classification Search
CPC ..... B41J 2/04586; B41J 2/0454; B41J 29/393
See application file for complete search history.

(56) References Cited

U.S. PATENT DOCUMENTS

2011/0249053 A1* 10/2011 Makita ..... B41J 2/04516 347/17

FOREIGN PATENT DOCUMENTS

JP 2010-208068 A 9/2010

* cited by examiner

*Primary Examiner* — Lamson Nguyen

(57) ABSTRACT

An ink jet printer according to an aspect of the invention includes a heat platen that is capable of heating in a state of supporting recording sheets, a head that discharges ink onto the recording sheets from a nozzle plate in which nozzles are provided, a temperature sensor that acquires temperature information of the nozzle plate, a main scanning portion that performs a main scanning operation that relatively moves the head in a main scanning direction with respect to the recording sheets, a sub-scanning portion that performs a sub-scan operation that relatively moves the recording sheets in a sub-scanning direction, which intersects the main scanning direction, with respect to the head, and a determination portion that determines the necessity of a heating operation, in which the heat platen heats the nozzle plate, on the basis of the temperature information before printing.

5 Claims, 9 Drawing Sheets

PRINTING APPARATUS AND PRINTING METHOD

BACKGROUND

1. Technical Field

The present invention relates to a printing apparatus and a printing method.

2. Related Art

In the related art, in ink jet type printers, printers that have a heating mechanism for drying a printing surface of a printing medium such as sheets of paper in the vicinity of a head in accordance with increases in printing speed, is known.

JP-A-2010-208068 discloses a liquid ejecting apparatus (an ink jet printer) that acquires temperature information due to a temperature detection unit being installed in order to detect whether or not a temperature rise (temperature change) has occurred in the head, and corrects a head driving waveform on the basis of the temperature information since the viscosity of an ink changes due to a temperature rise of the head occurring and it is necessary to correct a head driving waveform in a case in which a heating mechanism is used in order to dry a printing medium.

However, in the liquid ejecting apparatus (the ink jet printer) of JP-A-2010-208068, there is room for improvement in the correction with respect to temperature change, and there is a problem in that the color of fixed ink changes after printing is initiated.

SUMMARY

The invention can be realized in the following aspects or application examples.

Application Example 1

According to this application example, there is provided a printing apparatus including a heat platen that is capable of heating in a state of supporting a medium, a head that discharges a liquid onto the medium from a nozzle plate in which nozzles are provided, a temperature acquisition portion that acquires temperature information of the nozzle plate, a main scanning portion that performs a main scanning operation that relatively moves the head in a main scanning direction with respect to the medium, a sub-scanning portion that performs a sub-scan operation that relatively moves the medium in a sub-scanning direction, which intersects the main scanning direction, with respect to the head, and a determination portion that determines the necessity of a heating operation, in which the heat platen heats the nozzle plate, on the basis of the temperature information before printing.

According to the application example, as a result of acquiring temperature information of the nozzle plate before printing and disposing the nozzle plate over the heat platen, which is capable of heating the nozzle plate on the basis of the temperature information, since the heat of the heat platen is transmitted to the nozzle plate and it is possible to set a liquid (an ink) inside the nozzle plate to a desired temperature, it is possible to set the viscosity of the liquid inside the nozzle plate to be constant before printing. Therefore, it is possible to reduce changes in the color of fixed ink after printing is initiated.

Application Example 2

In the printing apparatus according to the application example, it is preferable that the heating operation be performed by repeating the main scanning operation.

According to the application example, as a result of repeating the heating operation of the nozzle plate in the main scanning operation direction, which is a longitudinal direction of the heat platen, the nozzle plate normally operates over the heat platen. Since the main scanning operation is a function that firmware is provided with, and is not accompanied by the addition of a new function for a heating operation, it is possible to easily set the liquid inside the nozzle plate to have a desired temperature. Therefore, it is possible to set the viscosity of the liquid inside the nozzle plate to be constant before printing, and therefore, it is possible to reduce a circumstance in which the color of the liquid changes after printing is initiated.

Application Example 3

In the printing apparatus according to the application example, it is preferable that the heating operation be performed in a state in which the head is stopped over the heat platen by the main scanning portion.

According to the application example, since the heat of the heat platen is transmitted to the nozzle plate more quickly as a result of performing the heating operation of the nozzle plate by stopping over the heat platen, it is possible to set the liquid inside the nozzle plate to a desired temperature. Therefore, it is possible to set the viscosity of the liquid inside the nozzle plate to be constant before printing, and therefore, it is possible to reduce a circumstance in which the color of the liquid changes after printing is initiated.

Application Example 4

It is preferable that the printing apparatus according to the application example further include a control portion that executes determination using the determination portion in a case in which the temperature that is applied to the nozzle plate from the heat platen is higher than a predetermined temperature.

According to the application example, since determination is performed according to necessity, it is possible to suppress a deterioration in throughput.

Application Example 5

According to this application example, there is provided a printing method in a printing apparatus including a heat platen that is capable of heating in a state of supporting a medium, a head that discharges a liquid onto the medium from a nozzle plate in which nozzles are provided, a temperature acquisition portion that acquires temperature information of the nozzle plate, a main scanning portion that performs a main scanning operation that relatively moves the head in a main scanning direction with respect to the medium, and a sub-scanning portion that performs a sub-scan operation that relatively moves the medium in a sub-scanning direction, which intersects the main scanning direction, with respect to the head, the method including determining the necessity of a heating operation, in which the heat platen heats the nozzle plate, on the basis of the temperature information before printing.

According to the application example, as a result of acquiring temperature information of the nozzle plate before printing and determining the necessity of the heating operation in which the heat platen heats the nozzle plate on the basis of the temperature information, since the heat of the heat platen is transmitted to the nozzle plate and it is possible to set the liquid (the ink) inside the nozzle plate to a desired temperature, it is possible to set the viscosity of the liquid inside the nozzle plate to be constant before printing. Therefore, it is possible to reduce changes in the color of fixed ink after printing is initiated.

The invention can also be realized in various forms. For example, the invention can be realized as a printing method, a control method of a printing apparatus, a computer program for realizing one of these methods, a recording medium on which such a computer program is stored, or the like.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
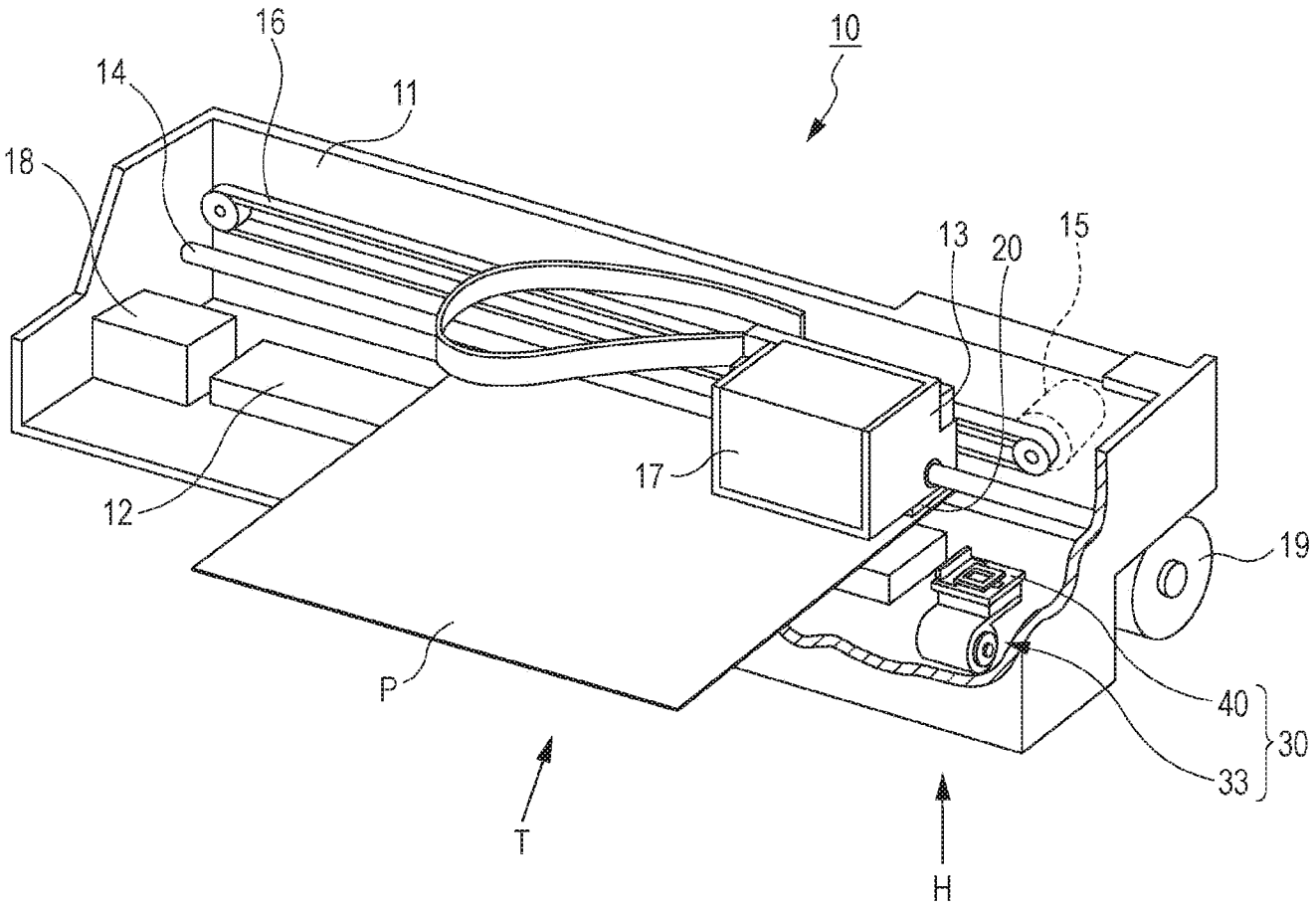
FIG. 1 is a perspective view that shows a schematic configuration of a printing apparatus according to an embodiment of the invention.

Hereinafter, embodiments of the invention will be described with reference to the drawings. Additionally, in each drawing shown below, there are cases in which the dimensions and ratios of each constituent element have been altered as appropriate from those of the actual constituent elements in order to set each constituent element to a size of an extent that can be recognized in the drawings. In addition, a direction in which a carriage 13 (a head 20), which will be mentioned later, moves is set as a main scanning direction and a direction in which recording sheets P are transported, which is a direction that intersects the main scanning direction, is set as a sub-scanning direction.

Firstly, an ink jet printer will be described with reference to FIG. 1 as an example of a printing apparatus according to an embodiment of the invention.

FIG. 1 is a block diagram that shows a schematic configuration of an ink jet printer 10 according to an embodiment of the invention.

As shown in FIG. 1, the ink jet printer 10 includes a frame 11, and a heat platen 12 is disposed due to the frame 11. The heat platen 12 is provided with a heater, and includes a heating mechanism for drying recording sheets P, as a medium.

A configuration in which the recording sheets P are fed over the heat platen 12 by a paper feeding mechanism, which includes a paper feeding motor 19, is used. In addition, the ink jet printer 10 includes the carriage 13, the carriage 13 is supported so as to be capable of moving in the main scanning direction, which is a longitudinal direction of the heat platen 12 via a guide member 14, and has a configuration in which a reciprocating motion is performed in the main scanning direction by a carriage motor 15 via a timing belt 16.

The ink jet type head 20 is included in the carriage 13 in a lower portion, which is the heat platen 12 side, and the head 20 has a configuration in which an ink is discharged, as a liquid, onto the recording sheets P.

Figure 2:
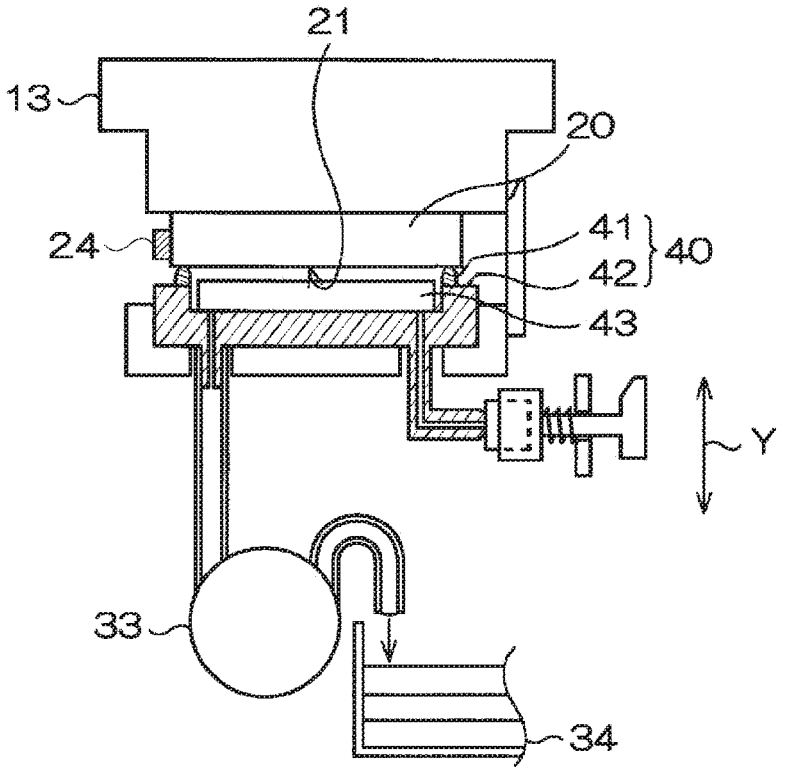
FIG. 2 is a schematic view that shows a schematic configuration of a head cleaning mechanism.

More specifically, the head 20 includes nozzles (nozzle openings) that discharge the ink, and the nozzles are formed in a nozzle plate 21 (a nozzle opening formation surface) (refer to FIG. 2).

Additionally, a temperature sensor 24 (refer to FIG. 2) is disposed in the head 20 as a temperature acquisition portion that measures the temperature of the nozzle plate 21.

In addition, an ink cartridge 17, in which the ink is accommodated, is mounted on the carriage 13 so as to be capable of being removed, and the ink is supplied to the head 20 from the ink cartridge 17.

That is, character printing, and the like, are performed as a result of ink being discharged onto the recording sheets P from the head 20 on the basis of printing data while the carriage 13 moves along the heat platen 12.

In addition, the recording sheets P are disposed in the frame 11 of FIG. 1, and a printing region T, in which character printing, and the like, are performed on the recording sheets P, is formed. Further, a home position H, which is a non-printing region, is also formed on the right side of the printing region T in the drawing. A configuration in which it is possible for the carriage 13 to move between the printing region T and the home position H as a result of moving along the heat platen 12 is used.

Additionally, the recording sheets P, on which character printing, and the like, have been performed, are transported in the sub-scanning direction, which is a direction that intersects a direction in which the carriage 13 moves along the heat platen 12 from the printing region T side, as a result of the paper feeding motor 19 being driven in a rotational manner.

As shown in FIG. 1, a head cleaning mechanism 30 is disposed in the home position H. The head cleaning mechanism 30 includes a cap 40 and a tube pump 33 (an example of a pump portion). In addition, the cap 40 has a configuration that is capable of moving up and down due to a publicly-known raising/lowering unit, which is not illustrated in the drawings.

In addition, a control portion 18 that controls the movement of the carriage 13, the head 20, which discharges the ink, the paper feeding motor 19, which moves the recording sheets P, the head cleaning mechanism 30, which cleans the head 20, and each operation, and the like, are disposed in the frame 11.

The control portion 18 is provided with a main scanning portion, a sub-scanning portion, and a determination portion for controlling each operation, and the like.

The main scanning portion is a portion that controls a main scanning operation, which relatively moves the head 20 in the main scanning direction with respect to the recording sheets P, and the sub-scanning portion is a portion that controls a sub-scanning operation that relatively moves the recording sheets P in the sub-scanning direction, which intersects the main scanning direction, with respect to the head 20. In addition, the determination portion determines the necessity of a heating operation, in which the heat platen 12 heats the nozzle plate 21, on the basis of the temperature information of the nozzle plate 21 before printing.

Next, the head cleaning mechanism 30 will be described with reference to FIG. 2.

FIG. 2 is a schematic view that shows a schematic configuration of a head cleaning mechanism 30.

The cap 40 has a configuration that either abuts against or is separated from the nozzle plate 21 as a result of an up and down motion along an arrow Y direction in FIG. 2.

More specifically, when the cap 40 abuts against the nozzle plate 21 in a manner that covers the nozzles of the head 20, the inside of the cap 40 becomes a substantially enclosed space in terms of the relationship with the nozzle plate 21. This state corresponds to a state in which capping of the head 20 is performed using the cap 40. The cap 40 is configured by a substantially box form cap holder 42, the upper surface of which is open, and a cap portion 41 composed of an elastic member.

In this instance, when the cap 40 abuts against the nozzle plate 21, the cap portion 41 becomes adhered to the nozzle plate 21. In this state, evaporation of the ink inside the nozzles is suppressed. Additionally, the cap portion 41 is formed as a result of two color formation on the upper portion of the cap holder 42. On the other hand, in a case in which the cap 40 is separated from the nozzle plate 21, the inside of the cap 40 is in an open state.

Additionally, in FIG. 2, a configuration example in which the cap portion 41 of the cap 40 abuts against the nozzle plate 21 is shown, but any configuration may be used as long as the cap 40 forms an enclosed space as a result of becoming adhered to the head 20 in a manner that surrounds the nozzles and the nozzles are disposed in the inner portion of the enclosed space. Accordingly, the cap 40 may have a configuration of becoming adhered to a portion of the head 20 other than the nozzle plate 21, for example, the side surfaces of the head 20.

In addition, in the present embodiment, the tube pump 33, which suctions ink, and the like, inside the cap 40, is connected to the cap 40, and ink, and the like, inside the cap 40 are suctioned as a result of the tube pump 33 being driven. At this time, it is necessary for the cap portion 41 to be adhered to the nozzle plate 21 of the head 20 in order to enlarge the negative pressure using the tube pump 33.

A waste ink tank 34, in which ink, and the like, attached to the nozzle plate 21, which are suctioned by the tube pump 33, is accommodated, is connected to the tube pump 33. Accordingly, a configuration in which the ink that the head 20 discharges is accommodated in the waste ink tank 34 via the tube pump 33 is used.

Figure 3:
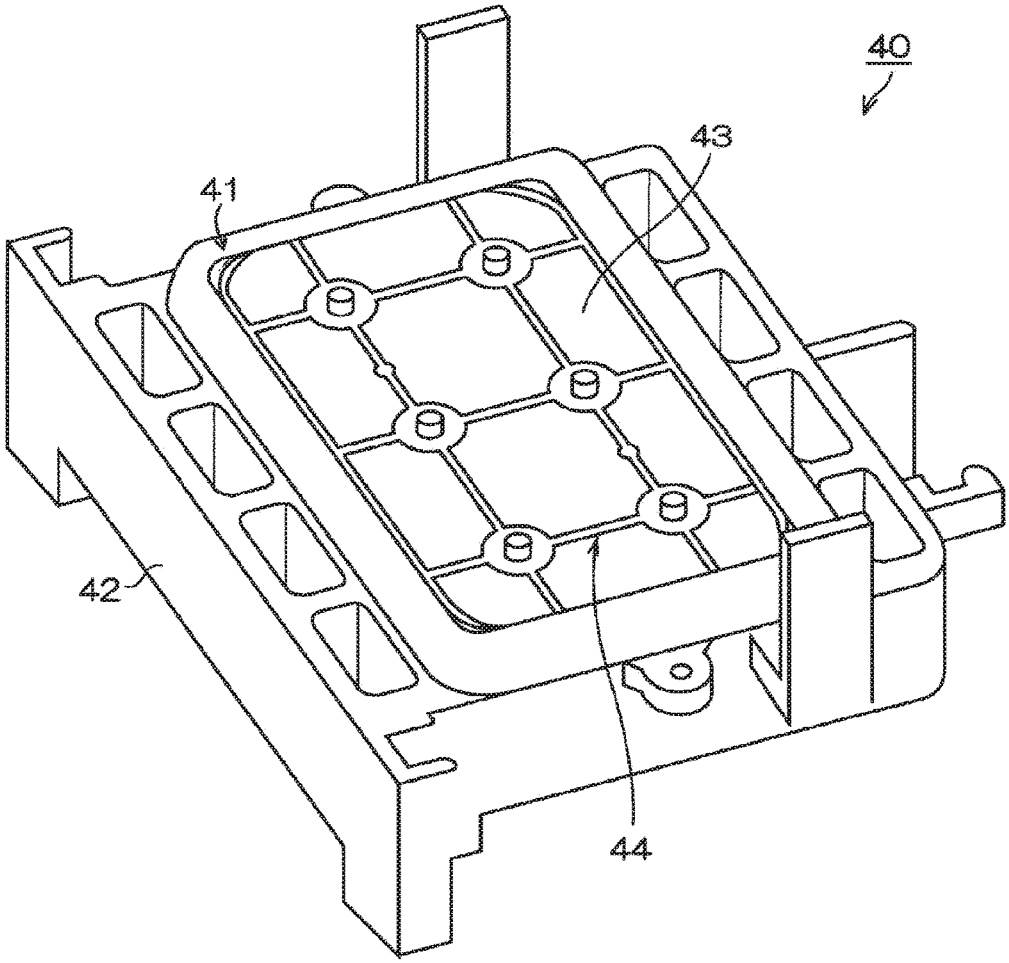
FIG. 3 is a perspective view that shows a schematic configuration of a cap.

In addition, an ink absorbing material 43, which absorbs ink ejected from the nozzles of the head 20, is disposed inside the cap 40. As shown in FIG. 3, the absorbing material 43 is fixed by a pressing spring 44.

Next, the cap 40 will be described with reference to FIG. 3.

FIG. 3 is a perspective view that shows a schematic configuration of the cap 40.

As shown in FIG. 3, in the cap 40, the substantially rectangular cap portion 41 is formed in the upper portion of the cap holder 42, and when capping of the head 20 is performed, the cap portion 41 becomes adhered to the nozzle plate 21 in a manner that surrounds the nozzles of the head 20. As a result of this, the nozzles are no longer in contact with external air.

However, since an ejection port of the tube pump 33, which is connected to the cap 40, is open, the cap 40 does not completely seal the nozzles. The reason for this is in order to prevent a circumstance in which there is a discharge fault as a result of the ink meniscii of the nozzles collapsing when there are pressure fluctuations inside the cap 40 die to temperature changes, and the like. Further, as shown in FIG. 2, in order to control evaporation from the ejection port, a connection portion of the tubes of the cap holder 42 and the tube pump 33 is made to be sufficiently narrow, and in addition, the connection portion is covered by the absorbing material 43. In a state such as this, the cap holder 42 has the greatest influence on the evaporation of the ink.

In this instance, a cause of the color, or in particular, the brightness of the color of fixed ink changing after printing is initiated, which is the problem, will be described.

Before printing, the head 20 stands by over the cap 40 in order to prevent cleaning of the head 20 (the nozzle plate 21), evaporation of the ink inside the nozzle plate 21, and the like. Further, after a signal for printing initiation is received, printing is performed by discharging the ink onto a recording sheet P as a result of performing a reciprocating motion in the main scanning direction over the heat platen 12, which includes the heating mechanism for drying the recording sheets P. Due to the reciprocating motion over the heat platen 12 being performed, the temperature of the nozzle plate 21 rises as a result of being heated by the heat of the heat platen 12. When the temperature of the nozzle plate 21 rises, the viscosity of the ink inside the nozzle plate 21 falls, and therefore, the discharge amount of the ink increases with respect to a target value. Therefore, the color of the ink that is fixed to the recording sheets P becomes more saturated with respect to a target value, and therefore, the brightness of the color of the ink becomes darker. Accordingly, in comparison with the initiation of printing, while printing is underway, the nozzle plate 21 is warmed by the heat platen 12, and the brightness of the color of fixed ink changes.

In such an instance, a method that reduces changes in the brightness of the color of fixed ink after the initiation of printing by performing preheating, which sets the temperature of the nozzle plate 21 to be constant before printing, has been devised.

In other words, before printing, the heating operation of the nozzle plate 21 performs preheating, which sets the temperature of the nozzle plate 21 to be constant using the heat of the heat platen 12, and therefore, sets the viscosity of the ink inside the nozzle plate 21 to be constant by repeating the main scanning operation, which relatively moves in the main scanning direction over the heat platen 12.

In addition, the heating operation of the nozzle plate 21 may also be performed by stopping over the heat platen 12. As a result of stopping the nozzle plate 21 over the heat platen 12, the heat of the heat platen 12 is transmitted to the nozzle plate 21 more quickly, and therefore, it is possible to rapidly set the temperature of the nozzle plate 21 to be constant.

Next, a preheating sequence according to which the ink jet printer 10 of the present embodiment reduces changes in the brightness of the color of fixed ink after the initiation of printing, will be described with reference to FIG. 4.

Figure 4:
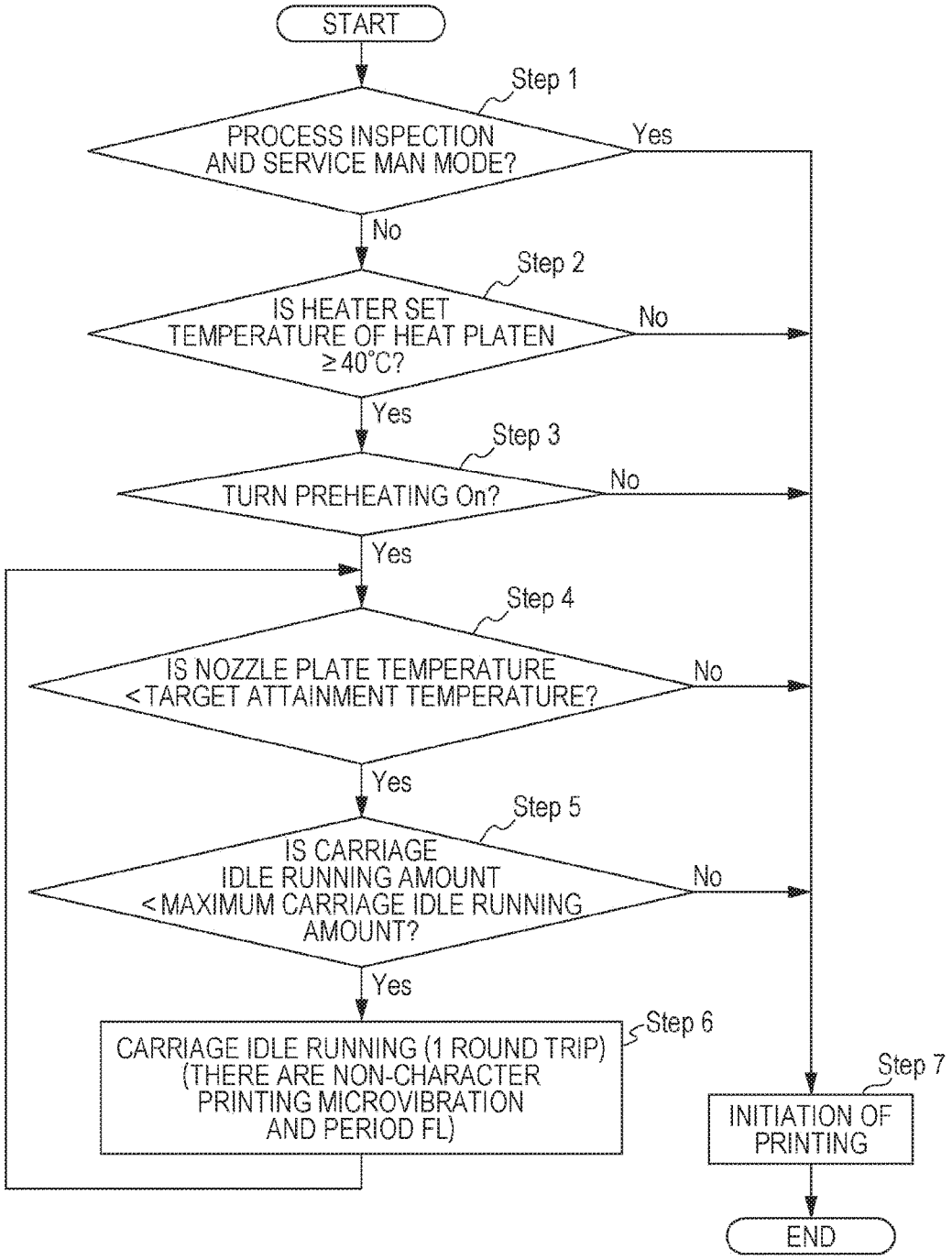
FIG. 4 is a flowchart in a preheating sequence.

FIG. 4 is a flowchart in the preheating sequence.

The preheating sequence of the nozzle plate 21 in the ink jet printer 10 acquires temperature information of the nozzle plate 21 before printing, and sets the viscosity of the ink inside the nozzle plate 21 to be constant before printing by warming the ink inside the nozzle plate 21 to a desired temperature as a result of heating the nozzle plate 21 using the heat platen 12 on the basis of the temperature information. As a result of performing this action, it is possible to reduce a circumstance in which the brightness of the color of fixed ink changes after printing is initiated.

As shown in FIG. 4, firstly, in Step 1, the flowchart in the preheating sequence of the nozzle plate 21 checks the state of the ink jet printer 10. In other words, whether or not a normal printing process, process inspection, a serviceman mode, or the like, is being executed, is input. In this instance, in a case of process inspection and the serviceman mode, since printing is performed in a state in which the heater of the heat platen 12 is in an OFF state, the answer is "Yes", and the process proceeds to the initiation of printing of Step 7. In a case of a normal printing process, the answer is set as "No", and the process proceeds to Step 2.

Next, in Step 2, in a case in which high-quality printing, in which changes in the brightness of the color of fixed ink are reduced during printing, is being performed, a check of whether or not a heater setting temperature of the heat platen 12 is 40° C. or more is performed, the answer is set as "Yes", and the process proceeds to Step 3. As a result of setting the heater setting temperature of the heat platen 12 to 40° C. or more, it is possible to rapidly warm the nozzle plate 21 up to a target attainment temperature. Additionally, in the present embodiment, the setting temperature is set to 40° C., but the invention is not limited to this configuration, and may also be a temperature that is lower than 40° C. or a temperature that is higher than 40° C.

In Step 3, preheating of the nozzle plate 21 is implemented, and in a case in which high-quality printing, in which changes in the brightness of the color of fixed ink are reduced during printing, is being performed, the answer is set as "Yes", and the process proceeds to Step 4.

Next, in Step 4, the temperature of the nozzle plate 21 is measured by the temperature sensor 24, which is mounted in the head 20, and the necessity of the heating operation of the heat platen 12, which heats the nozzle plate 21, is determined in the determination portion, which is provided in the control portion 18. Further, if the temperature of the nozzle plate 21 has not reached the target attainment temperature (for example, 30° C.), the answer is set as "Yes", the process proceeds to Step 5, and the nozzle plate 21 is heated. In addition, if the temperature of the nozzle plate 21 has reached the target attainment temperature, the viscosity of the ink inside the nozzle plate 21 is considered to have become constant, the answer is set as "No", the process proceeds to Step 7, and printing is initiated without heating of the nozzle plate 21 being necessary.

In Step 5, in order to heat the nozzle plate 21, a check of whether or not a carriage idle running amount (number of times or time) for which the carriage 13 runs idle over the heat platen 12, has reached a maximum carriage idle running amount, is performed. Additionally, the maximum carriage idle running amount is decided in the determination portion on the basis of a temperature differential between the temperature of the nozzle plate 21 and the target attainment temperature. In a case in which the carriage idle running amount has not reached the maximum carriage idle running amount, the answer is set as "Yes", and the process proceeds to Step 6 in order to heat the nozzle plate 21. In a case in which the carriage idle running amount has reached the maximum carriage idle running amount, the viscosity of the ink inside the nozzle plate 21 is considered to have become constant, the answer is set as "No", the process proceeds to Step 7, and printing is initiated without heating of the nozzle plate 21 being necessary.

Next, in Step 6, non-character printing micro-vibration that prevents a circumstance in which the ink inside the nozzle plate 21 becomes clogged in the nozzles, and periodic flushing (FL) that disposes of thickened ink are implemented over the cap 40 for each round trip of carriage idle running. Thereafter, the process proceeds to Step 4 in order to check whether or not the temperature of the nozzle plate 21 has reached the target attainment temperature.

As a result of Step 4 to Step 6, the temperature of the nozzle plate 21 is made to reach the target attainment temperature, and the viscosity of the ink inside the nozzle plate 21 is set to be constant, and printing is initiated.

Next, the effects of implementing the preheating sequence will be described with reference to FIGS. 5 to 9.

Figure 5:
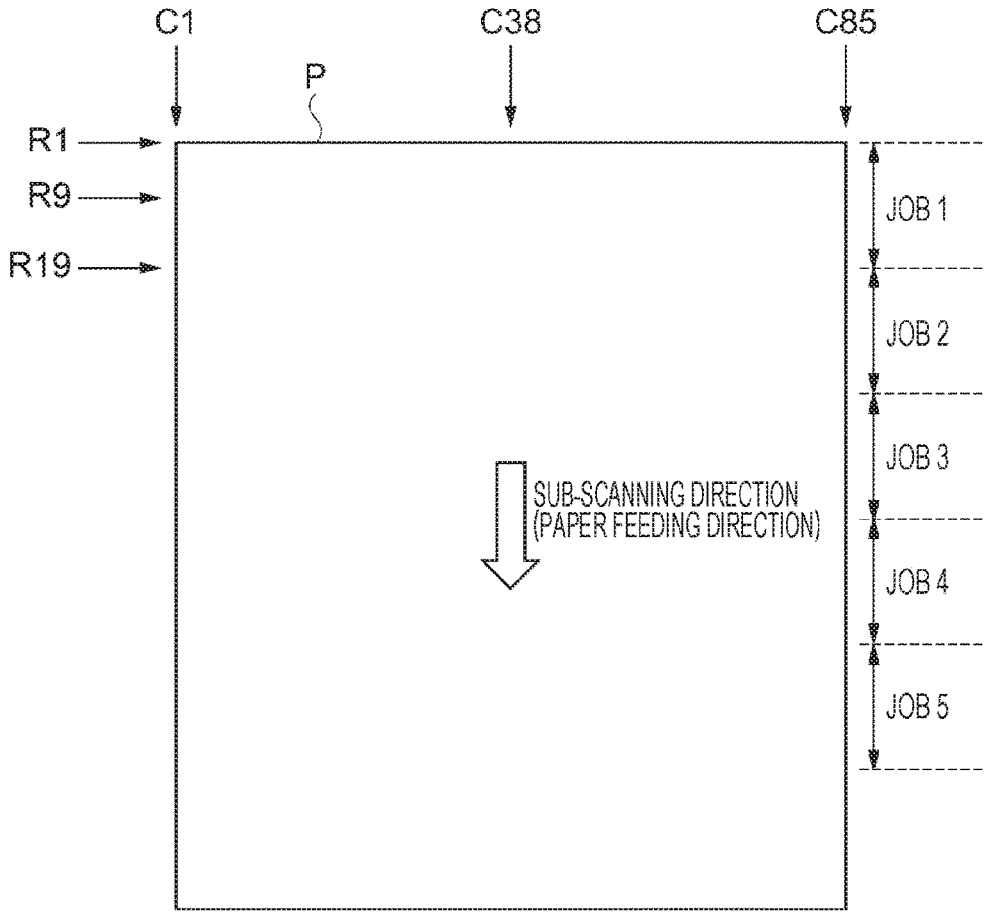
FIG. 5 is a plan view that shows a paper feeding direction and a measurement position of the brightness of a recording sheet.
Figure 6:
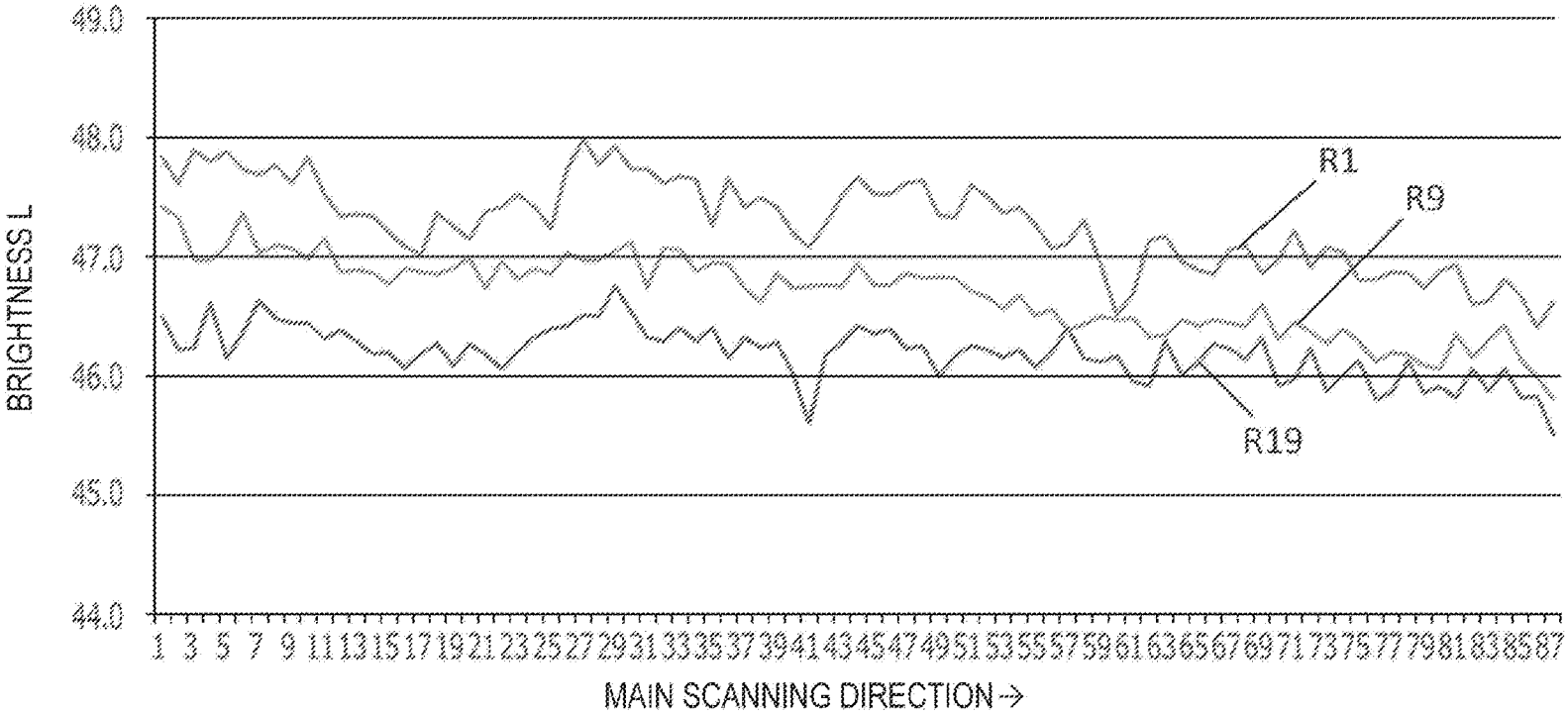
FIG. 6 is a graph in which measurement values of the brightness of the color of a liquid in a main scanning direction without preheating are plotted.
Figure 7:
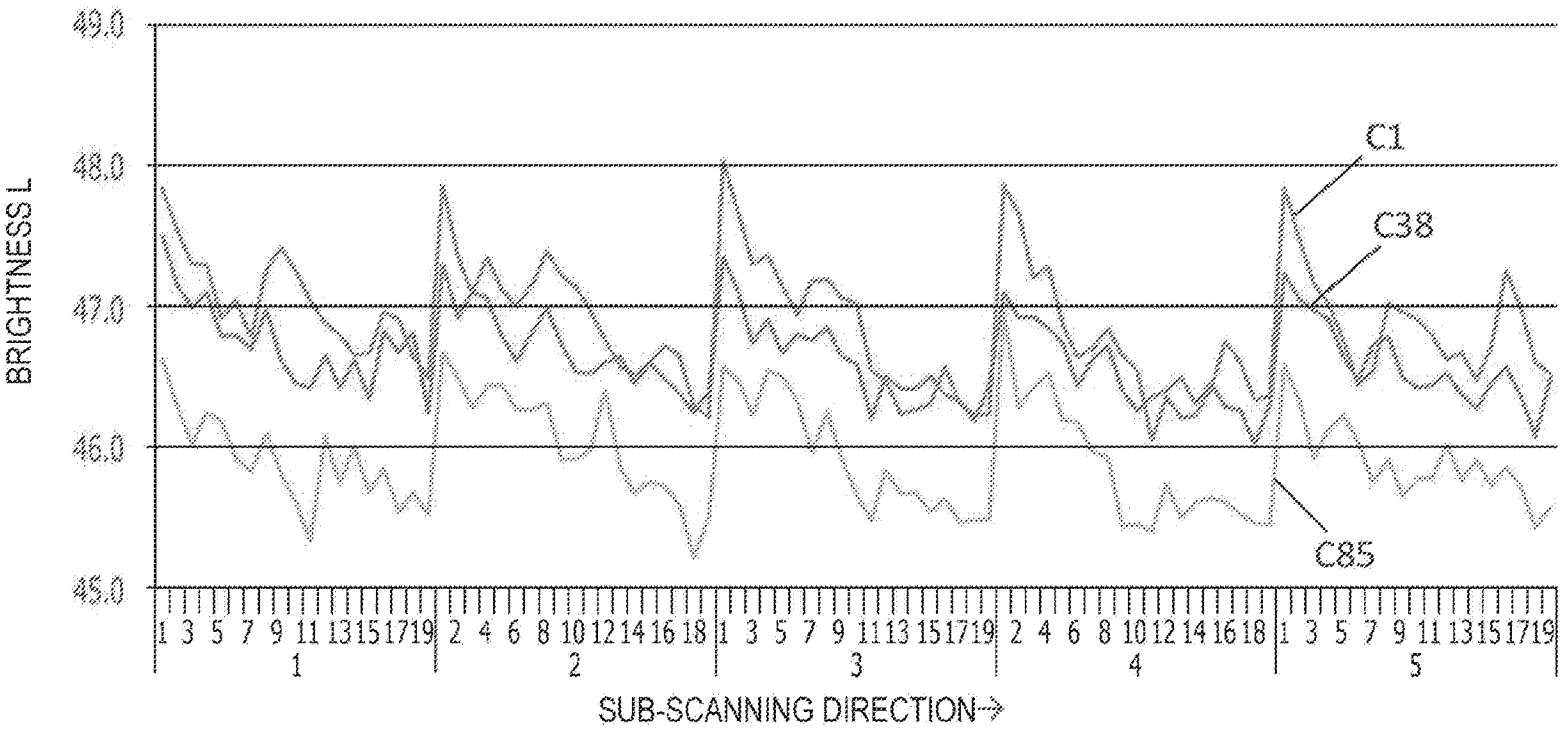
FIG. 7 is a graph in which the measurement values of the brightness of the color of a liquid in a sub-scanning direction without preheating are plotted.
Figure 8:
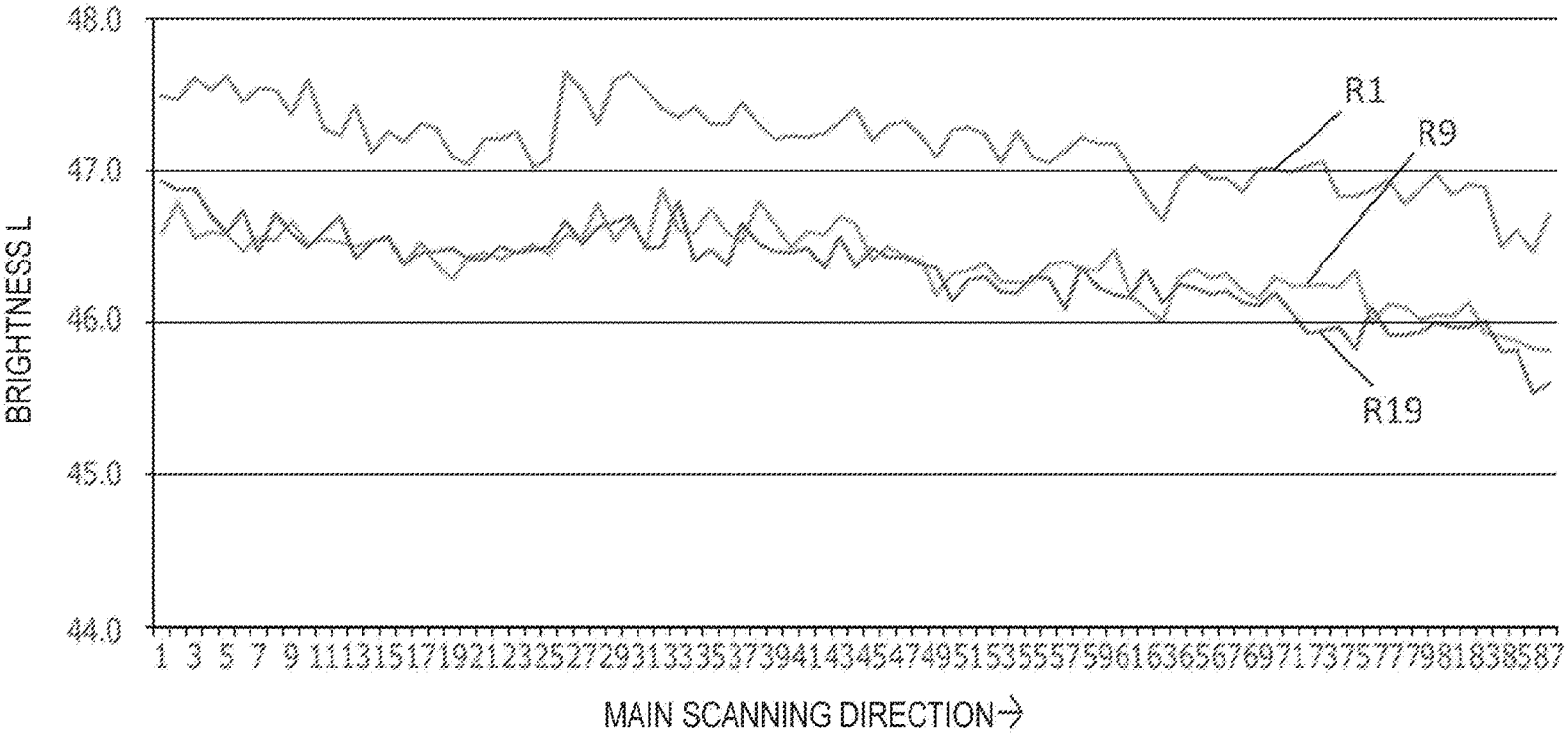
FIG. 8 is a graph in which the measurement values of the brightness of the color of a liquid in the main scanning direction with preheating are plotted.
Figure 9:
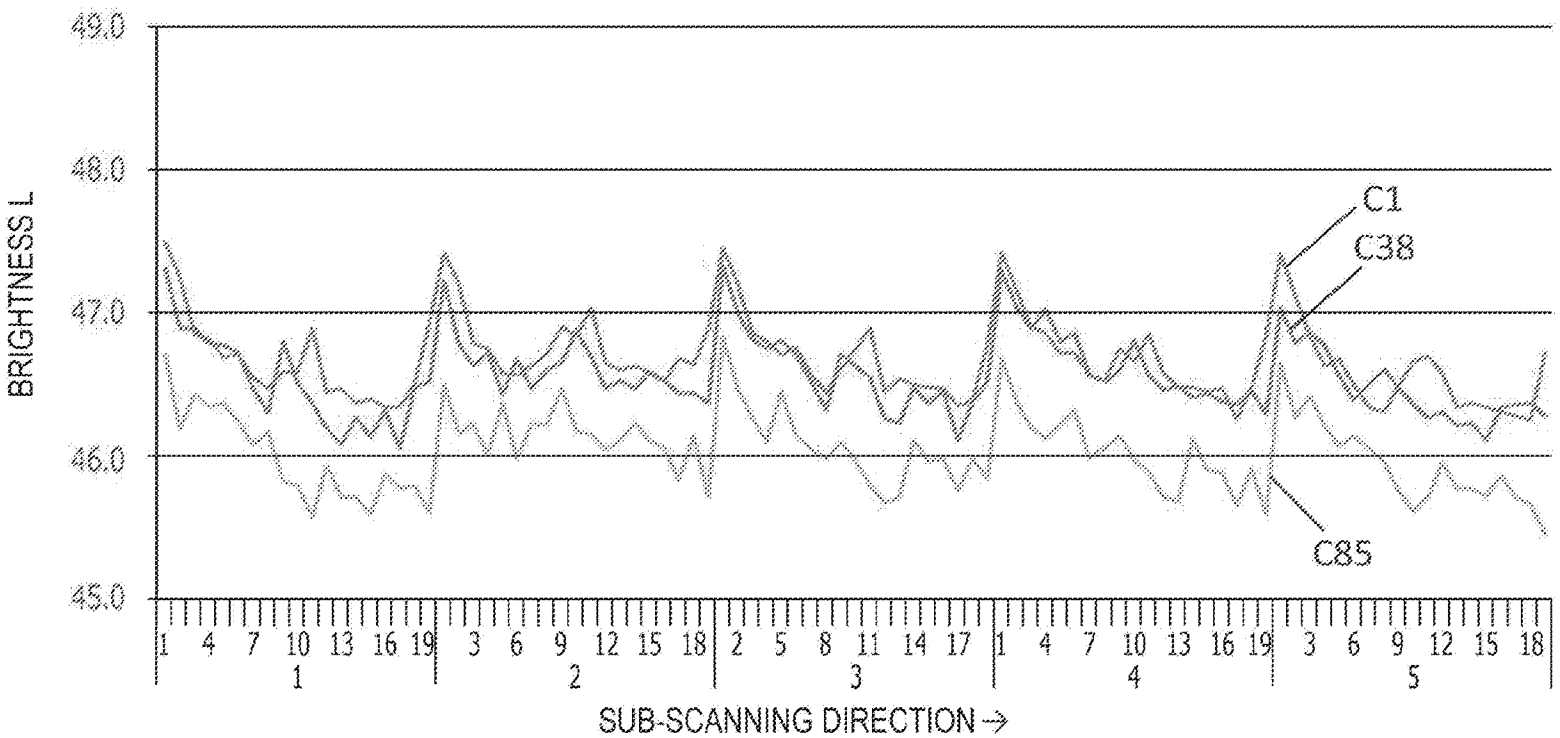
FIG. 9 is a graph in which the measurement values of the brightness of the color of a liquid in the sub-scanning direction with preheating are plotted.

FIG. 5 is a plan view that shows the sub-scanning direction of the recording sheets P and a measurement position of the brightness of the color of fixed ink. FIGS. 6 and 7 are graphs in which measurement values of the brightness of the color of fixed ink in the main scanning direction and the sub-scanning direction without preheating are plotted. FIGS. 8 and 9 are graphs in which measurement values of the brightness of the color of fixed ink in the main scanning direction and the sub-scanning direction with preheating are plotted.

The brightness of the color of fixed ink printed on the recording sheets P was measured in order to check the effect of the preheating sequence. FIG. 5 shows the sub-scanning direction (the paper feeding direction) of a recording sheet P used in measurement and measurement positions of the brightness of the color of fixed ink.

Additionally, the printing (the discharge of the ink) of the recording sheets P used in inspection is performed toward the position of C1 from the position of C85 by proceeding in the sub-scanning direction after initially reaching the position of the C85 as a result of being performed in the main scanning direction, which is the direction in which the carriage 13 (the head 20) moves, from the position of C1 and R1. Thereafter, the printing is performed toward the position of C85 from the position of C1 by proceeding in the sub-scanning direction at the position of C1. After performing printing up to the position of R19 by performing repetition of this action, since a detection process of the recording sheets P is performed, the carriage 13 (the head 20) stands by over the cap 40. Printing on a recording sheet P for inspection is completed by performing repetition of several jobs with the above-mentioned printing action set as a single job.

FIGS. 6 and 7 are graphs in which measurement values of the brightness L of the color of fixed ink without preheating are plotted. The vertical axis represents brightness, and higher numerical values show lightness. FIG. 6 is a graph in which the measurement values of the brightness L of the color of fixed ink of the positions R1, R9, and R19 of a recording sheet P are plotted along the main scanning direction, and shows a darkening tendency as a result of the brightness L of the color of fixed ink decreasing with progress in the main scanning direction. The reason for this is that the ink inside the nozzle plate 21 is warmed by the heat of the heat platen 12 when since the nozzle plate 21 moves over the heat platen 12 in order to perform printing, the viscosity of the ink falls, and therefore, the discharge amount of the ink increases as a result. In addition, the reason for the brightness L of the color of fixed ink being slightly darker in the order of the positions R1, R9, and R19 of the recording sheet P is that, with respect to the position R1 being in an initial period of printing, since the position R19 is the last position of printing, the time that the nozzle plate 21 spends over the heat platen 12 is long, the ink inside the nozzle plate 21 is warmed more, and therefore, the discharge amount of the ink is further increased.

FIG. 7 is a graph in which the measurement values of the brightness L of the color of fixed ink of the positions C1, C38, and C85 of a recording sheet P are plotted along the sub-scanning direction, and the brightness L of the color of fixed ink becomes darker with progress in the sub-scanning direction. Thereafter, when job 2 is performed, the brightness L of the color of fixed ink becomes high again, and the brightness L of the color of fixed ink decreases and becomes darker with progress in the sub-scanning direction. This tendency arises for each job. The reason for this is that the ink inside the nozzle plate 21, which is warmed by moving over the heat platen 12, is cooled as a result of the carriage 13 (the head 20) standing by over the cap 40 each time a job is finished in order to perform detection of the recording sheet P, and therefore, the viscosity of the ink increases. Therefore, when printing of a subsequent job is initiated, the discharge amount of the ink is reduced, and therefore, the brightness L of the color of fixed ink is high, and is light.

Next, FIGS. 8 and 9 are graphs in which measurement values of the brightness L of the color of fixed ink in a case in which the preheating sequence according to the present embodiment is performed are plotted.

FIG. 8 is a graph in which the measurement values of the brightness L of the color of fixed ink of the positions R1, R9, and R19 of a recording sheet P are plotted along the main scanning direction, and shows a darkening tendency as a result of the brightness L of the color of fixed ink decreasing with progress in the main scanning direction in the same manner as the case of no preheating of FIG. 6. However, there is less of a difference in the brightness L of the color of fixed ink between the position R1 and the position R19, and there is very little difference between the brightness L of the color of fixed ink between the position R9 and the position R19, which substantially coincide.

In addition, FIG. 9 is a graph in which the measurement values of the brightness L of the color of fixed ink of the positions C1, C38, and C85 of a recording sheet P are plotted along the sub-scanning direction, and shows a darkening tendency as a result of the brightness L of the color of fixed ink decreasing with progress in the sub-scanning direction in the same manner as the case of no preheating of FIG. 7. However, there is less of a difference in the brightness L of the color of fixed ink between the position C1 and the position C85, and in addition, there is also less of a difference between the brightness L of the color of fixed ink between the position C1 and the position C85 between each job.

Accordingly, as a result of executing the preheating sequence, it is possible to reduce a circumstance in which the brightness of the color of fixed ink changes after printing is initiated.

In the abovementioned manner, according to the printing apparatus 10, as the printing apparatus of the present embodiment, it is possible to obtain the following effects.

As a result of acquiring the temperature information of the nozzle plate 21 before printing and disposing the nozzle plate 21 over the heat platen 12, which is capable of heating the nozzle plate 21 on the basis of the temperature information, since the heat of the heat platen 12 is transmitted to the nozzle plate 21 and it is possible to set the ink inside the nozzle plate 21 to a desired temperature, it is possible to set the viscosity of the ink inside the nozzle plate 21 to be constant before printing. Therefore, it is possible to reduce changes in the color (the brightness of the color) of ink that is fixed to the recording sheets P after printing is initiated. Accordingly, it is possible to obtain an ink jet printer 10 in which there are few changes in the color (the brightness of the color) of ink after printing is initiated.

The configurations of each portion of the invention can be substituted with arbitrary configurations that exhibit similar functions of to those of the embodiment mentioned above, and in addition, it is also possible to add arbitrary configurations. In addition, a configuration in which arbitrary configurations of each embodiment mentioned above are combined may also be used.

This application claims priority under 35 U.S.C. § 119 to Japanese Patent Application No. 2016-067503, filed Mar. 30, 2016. The entire disclosure of Japanese Patent Application No. 2016-067503 is hereby incorporated herein by reference.

What is claimed is:

1. A printing apparatus comprising:

a heat platen configured to heat in a state of supporting a medium;

a head that discharges a liquid onto the medium from a nozzle plate in which nozzles are provided;

a temperature acquisition portion that acquires temperature information of the nozzle plate;

a main scanning portion that performs a main scanning operation that relatively moves the head in a main scanning direction with respect to the medium;

a sub-scanning portion that performs a sub-scan operation that relatively moves the medium in a sub-scanning direction, which intersects the main scanning direction, with respect to the head; and a determination portion that determines the necessity of a heating operation, in which the heat platen heats the nozzle plate, based on the temperature information before printing.

2. The printing apparatus according to claim 1, wherein the heating operation is performed by repeating the main scanning operation.

3. The printing apparatus according to claim 1, wherein the heating operation is performed in a state in which the head is stopped over the heat platen.

4. The printing apparatus according to claim 1, further comprising:

a control portion that executes determination using the determination portion in a case in which the temperature that is applied to the nozzle plate from the heat platen is higher than a predetermined temperature.

5. A printing method in a printing apparatus including a heat platen configured to heat in a state of supporting a medium, a head that discharges a liquid onto the medium from a nozzle plate in which nozzles are provided, a temperature acquisition portion that acquires temperature information of the nozzle plate, a main scanning portion that performs a main scanning operation that relatively moves the head in a main scanning direction with respect to the medium, and a sub-scanning portion that performs a sub-scan operation that relatively moves the medium in a sub-scanning direction, which intersects the main scanning direction, with respect to the head, the method comprising determining the necessity of a heating operation, in which the heat platen heats the nozzle plate, based on the temperature information before printing.

* * * * *